United States Patent [19]

Miyafuji et al.

[11] Patent Number: 4,656,003

[45] Date of Patent: Apr. 7, 1987

[54] COPPER ALLOY AND PRODUCTION OF THE SAME

[75] Inventors: Motohisa Miyafuji; Yasuhiro Nakashima, both of Yamaguchi; Satoru Katayama, Fukuoka; Takashi Matsui, Yamaguchi; Hidekazu Harada, Funabashi; Youji Yuki, Yamaguchi, all of Japan

[73] Assignee: Kabushiki Kaisha Kobe Seiko Sho, Kobe, Japan

[21] Appl. No.: 786,482

[22] Filed: Oct. 11, 1985

[30] Foreign Application Priority Data

Oct. 20, 1984 [JP] Japan ..... 59-221015
Nov. 24, 1984 [JP] Japan ..... 59-248400

[51] Int. Cl.[4] ..... C22C 9/06

[52] U.S. Cl. ..... 420/473; 148/433; 148/434; 148/435; 420/476

[58] Field of Search ..... 420/470, 473, 476, 477, 420/481, 482, 485, 487, 490, 492, 494, 495; 148/433, 434, 435

[56] References Cited

U.S. PATENT DOCUMENTS

Re. 31,180 3/1983 Plewes ..... 420/470

FOREIGN PATENT DOCUMENTS 59-9144 1/1984 Japan ..... 420/473
59-145749 8/1984 Japan ..... 420/473
60-152646 8/1985 Japan ..... 420/473

*Primary Examiner*—L. Dewayne Rutledge
*Assistant Examiner*—Robert L. McDowell
*Attorney, Agent, or Firm*—Oblon, Fisher, Spivak, McClelland & Maier

[57] ABSTRACT

There is provided a copper alloy which comprises 1.0 to 3.5 wt. % of Ni, 0.2 to 0.9 wt. % of Si, 0.02 to 1.0 wt. % of Mn, 0.1 to 5.0 wt. % of Zn, 0.1 to 2.0 wt. % of Sn, and 0.001 to 0.01 wt. % of Mg, and 0.001 to 0.01 wt. % of one or more members selected from Cr, Ti, and Zr, with the remainder being substantially Cu. The copper alloy is suitable for lead frames for semiconductors and is also suitable for terminals and connectors. The copper alloy is produced by a process which comprises starting cooling from a temperature above 600° C. at a rate of 5° C. per second or higher after hot rolling of an ingot of said copper alloy, performing annealing at a temperature of 400° to 600° C. for 5 minutes to 4 hours after cold working, performing refining finish rolling, and performing annealing at a temperature of 400° to 600° C. for a short time of 5 to 60 seconds.

4 Claims, No Drawings

COPPER ALLOY AND PRODUCTION OF THE SAME

BACKGROUND OF THE INVENTION

1. Field of the Invention

The present invention relates to a copper alloy and to a process for producing the same. More particularly, it relates to a copper alloy used as a lead frame material for semiconductors such as IC and LSI and to a process for producing the same. The lead frame material for semiconductors is superior in strength, stiffness strength, repeated bending characteristics, heat resistance, and electrical conductivity.

The present invention also relates to a copper alloy for terminals and connectors and to a process for producing the same. The copper alloy for terminals and connectors is characterized in that the electrical conductivity is at least 25% IACS and 80% of the initial hardness is retained even when heated at a temperature above 400° C. for 5 minutes.

2. Discussion of the Background

Heretofore, the lead frame materials for semiconductors have been made of Fe-42 wt% Ni alloy which has a coefficient of linear thermal expansion close to that of the elements and ceramics. However, with the recent improvement in bonding technique and sealing materials for the elements, it is being replaced by copper-based material which is superior in heat dissipation and yet is comparatively low in prace.

Nevertheless, there are no copper-based materials developed so far which have superior strength, repeated bending characteristics, and heat resistance comparable to those of the Fe-42 wt% Ni alloy and are suitable for the lead frame material for semiconductors such as IC and LSI which require high reliability. Therefore, there has been a demand for a copper-based material that has the above-mentioned characteristic properties.

Brass and phosphor bronze are the principal materials for terminals and connectors. The former has an advantage in having very good formability and workability; but it is extremely poor in stress corrosion cracking resistance. Thus the use of brass is now under reconsideration from the standpoint of reliability. As a substitute for brass, more reliable phosphor bronze has come into general use and there is an increasing demand for it. This is because thin terminals and connectors are required as the electronic parts are miniaturized, particularly as the degree of integration of IC is increased, and electric appliances become lighter, smaller, and thinner than before. This holds true in the automotive industry, too. In addition, efforts are being made to discover new merits in copper-rich copper alloys.

Phosphor bronze, however, has some disadvantages. That is, it is expensive because it contains more than 3.0 wt% of tin, which is expensive, as shown in the Japanese Industrial Standards. It is poor in creep resistance at high temperatures. The heat resistance temperature is low, and the electrical conductivity is lower than 25% IACS.

SUMMARY OF THE INVENTION

It is an object of this invention to provide a lead frame material for semiconductors and a process for producing the same. The lead frame material has superior characteristic properties such as high strength, good repeated bending characteristics, and high heat resistance which are comparable to those of lead frame materials made of Fe-42 wt% Ni alloy. Moreover, it is superior in electrical conductivity, corrosion resistance, stress corrosion cracking resistance, solderability, resistance to peeling of plated tin and solder by heat, and hot working characteristics.

It is another object of this invention to provide a copper alloy for terminals and connectors which is free of the above-mentioned disadvantages involved in the conventional phosphor bronze, and to provide a process for producing said copper alloy. The copper alloy of this invention contains less than 3 wt% of tin and therefore differs from phosphor bronze containing more than 3 wt% of tin as prescribed in the Japanese Industrial Standards. It has a high elastic limit and good heat resistance at high temperatures. It also has an electrical conductivity of at least 25% IACS. It retains 80% of its initial hardness even when heated at 400° C. or above for 5 minutes.

DETAILED DESCRIPTION OF THE PREFERRED EMBODIMENTS

The first invention disclosed herein is concerned with a copper alloy which comprises 1.0 to 3.5 wt% of Ni, 0.2 to 0.9 wt% of Si, 0.02 to 1.0 wt% of Mn, 0.1 to 5.0 wt% of Zn, 0.1 to 2.0 wt% of Sn, 0.001 to 0.01 wt% of Mg, and 0.001 to 0.01 wt% of one or more members selected from Cr, Ti, and Zr, with the remainder being substantially Cu.

The second invention disclosed herein is concerned with another copper alloy which comprises 1.0 to 3.5 wt% of Ni, 0.2 to 0.9 wt% of Si, 0.01 to 1.0 wt% of Mn, 0.1 to 5.0 wt% of Zn, 0.1 to 2.0 wt% of Sn, and 0.001 to 0.01 wt% of Mg, and 0.001 to 0.01 wt% of one or more members selected from Cr, Ti, and Zr, with the remainder being substantially Cu.

The third invention disclosed herein is concerned with a copper alloy used as a lead frame material for semiconductors.

The fourth invention disclosed herein is concerned with a copper alloy for terminals and connectors.

The fifth invention disclosed herein is concerned with a process for producing a lead frame material for semiconductors which comprises starting cooling from a temperature above 600° C. at a rate of 5° C. per second or higher after hot rolling of an ingot of an alloy, performing annealing at a temperature of 400° to 600° C. for 5 minutes to 4 hours after cold working, performing refining finish rolling, and performing annealing at a temperature of 400° to 600° C. for a short time of 5 to 60 seconds, said alloy comprising 1.0 to 3.5 wt% of Ni, 0.2 to 0.9 wt% of Si, 0.02 to 1.0 wt% of Mn, 0.1 to 5.0 wt% of Zn, 0.1 to 2.0 wt% of Sn, and 0.001 to 0.01 wt% of Mg, and 0.001 to 0.01 wt% of one or more members selected from Cr, Ti, and Zr, with the remainder being substantially Cu.

The sixth invention disclosed herein is concerned with a process for producing a copper alloy for terminals and connectors which comprises starting cooling from a temperature above 600° C. at a rate of 5° C. per second or higher after hot rolling of an ingot of an alloy, performing annealing at temperature above 600° C. for 5 seconds to 4 hours after cold working, hours after cold rolling, performing refining finish rolling, and performing tension annealing at a temperature of 300° to 600° C. for a short time of 5 to 60 seconds, said alloy comprising 1.0 to 3.5 wt% of Ni, 0.2 to 0.9 wt% of Si, 0.01 to 1.0 wt% of Mn, 0.1 to 5.0 wt% of Zn, 0.1 to 2.0 wt% of Sn, 0.001 to 0.01 wt% of Mg, and 0.001 to 0.01 wt% of one or more members selected from Cr, Ti, and Zr, with the remainder being substantially Cu.

A detailed description is given below of the lead frame material for semiconductors and the process for producing the same which are associated with the present invention.

The following description is concerned with the composition of the lead frame material for semiconductors.

Ni is an element that affords strength. If the content is less than 1.0 wt%, no improvement is made in strength and heat resistance even if Si is contained in an amount of 0.2 to 0.9 wt%. A Ni content in excess of 3.5 wt% decreases electrical conductivity and is uneconomical. Thus the content of Ni should be 1.0 to 3.5 wt%.

Si is an element that, together with Ni, affords strength. If the Si content is less than 0.2 wt%, no improvement is made in strength and heat resistance even if Ni is contained in an amount of 1.0 to 3.5 wt%. A Si content in excess of 0.9 wt% decreases electrical conductivity and aggravates hot working characteristics. Thus the content of Si should be 0.2 to 0.9 wt%.

Mn is an element that improves hot working characteristics. If the $M_n$ content is less than 0.02 wt%, only a little effect is produced. A $M_n$ content in excess of 1.0 wt% adversely affects fluidity at the time of casting and decreases the yield of ingot making. Thus the content of Mn should be 0.02 to 1.0 wt%.

Zn is an element that greatly improves the resistance to peeling of plated tin and solder by heat. If the Zn content is less than 0.1 wt%, only a little effect is produced. A Zn content in excess of 5.0 wt% adversely affects solderability. Thus the content of Zn should be 0.1 to 5.0 wt%.

Sn is an element that improves stiffness strength and repeated bending characteristics. If the Sn content is less than 0.1 wt%, only a little effect is produced. A Sn content in excess of 2.0 wt% adversely affects electrical conductivity, heat resistance, and hot working characteristics. Thus the content of Sn should be 0.1 to 2.0 wt%.

Mg is an essential element that forms a compound in the matrix with S which inevitably enters, thereby permitting hot working. If the content of Mg is less than 0.001 wt%, S is not made into a stable MgS but remains as such or in the form of MnS. S or MnS migrates to the grain boundary to cause cracking during heating for hot rolling or during hot rolling. A content of Mg in excess of 0.01 wt% causes the ingot to crack when it is heated above 722° C. due to a eutectic $Cu+MgCu_2$ (melting point 722° C.) formed therein, causes the molten metal to be oxidized, makes poor the fluidity of the molten metal, and makes the ingot poor in quality, decreasing the yield of ingot making. Thus the content of Mg should be 0.001 to 0.01 wt%.

Cr, Ti, and Zr are elements that improve the hot rolling characteristics. If their content is less than 0.001 wt%, only a little effect is produced; and if their content exceeds 0.01 wt%, the fluidity of the molten metal is poor at the time of ingot casting and the yield of ingot making decreases. Thus the content of Cr, Ti, or Zr should be 0.001 to 0.01 wt%. Where two or more members of Cr, Ti, and Zr are contained, their total content should be 0.001 to 0.01 wt% for the same reasons mentioned above.

The next description is concerned with the process for producing the lead frame material for semiconductors.

After hot rolling of an ingot of the copper alloy of the above-mentioned composition, cooling is started from a temperature above 600° C. at a rate of 5° C. per second or higher in order to accomplish solution treatment. If cooling starts from a temperature below 600° C., precipitation taes place before the start of cooling and solution treatment is not accomplished completely, even though the cooling rate is higher than 5° C. per second. This adversely affects the subsequent cold working. Likewise, if the cooling rate is lower than 5° C. per second, precipitation takes place during cooling and solution treatment is not accomplished completely, even though cooling starts from a temperature above 600° C. This also adversely affects the subsequent cold working.

After cold working, annealing is performed at a temperature of 400° to 600° C. for 5 minutes to 4 hours in order to cause the Ni-Si compound to precipitate. If the annealing temperature is lower than 400° C., the precipitation of the Ni-Si compound is incomplete even though the annealing time is 5 minutes to 4 hours. On the other hand, at annealing temperatures higher than 600° C., precipitation does not take place and Ni and Si mostly remain in the form of a solid solution. In either case, Ni and Si remaining in the form of a solid solution considerably aggravate the resistance to peeling of plated tin and solder by heat. Thus the annealing temperature should be 400° C. to 600° C., and the annealing time should be 5 minutes to 4 hours. Annealing shorter than 5 minutes does not provide sufficient precipitation and annealing longer than 4 hours is uneconomical.

After refining finish rolling, annealing is performed again at a temperature of 400° to 600° C. for a short time of 5 to 60 seconds in order to restore elongation that has decreased due to rolling and to reduce and make uniform residual stresses. Annealing at a temperature lower than 400° C. does not produce a desired effect even though the annealing lasts for 5 to 60 seconds. Conversely, annealing at a temperature higher than 600° C. returns the precipitated Ni-Si compound to the solid solution, resulting in a product of poor properties. Thus the annealing temperature should be 400° to 600° C. Annealing time less than 5 seconds is not sufficient to restore elongation and to reduce and make uniform residual stresses. Annealing for 60 seconds or longer is uneconomical, with reduced productivity, because heat treatment of this kind is usually carried out in a continuous production line. Thus the annealing time should be 5 to 60 seconds.

A detailed description is given below of the copper alloy for terminals and connectors and the process for producing the same which are associated with the present invention.

The following description is concerned with the composition of the copper alloy for terminals and connectors.

Ni is an element that affords strength. If the Ni content is less than 1.0 wt%, no improvement is made in strength and heat resistance even if Si is contained in an amount of 0.2 to 0.9 wt%. A Ni content in excess of 3.5 wt% does not produce any more effect and is uneconomical. Thus the content of Ni should be 1.0 to 3.5 wt%.

Si is an element that, together with Ni, affords strength. If the Si content is less than 0.2 wt%, no improvement is made in strength and heat resistance even if Ni is contained in an amount of 1.0 to 3.5 wt%. A Si content in excess of 0.9 wt% decreases electrical conductivity and aggravates hot working characteristics and makes only a little improvement in heat resistance. Thus the content of Si should be 0.2 to 0.9 wt%. Excess Ni or Si decreases electrical conductivity because they form an Ni-Si intermetallic compound and they are also present in the form of solid solution.

Mn is an element that improves hot working characteristics. If the Mn content is less than 0.01 wt%, only a little effect is produced. A Mn content in excess of 1.0 wt% adversely affects fluidity at the time of casting and considerably decreases the yield of ingot making. Thus the content of Mn should be 0.01 to 1.0 wt%.

Zn is an element that greatly improves the resistance to peeling of plated tin and solder by heat. It also greatly improves the workability at high temperatures. If the Zn content is less than 0.1 wt%, only a little effect is produced. A Zn content in excess of 5.0 wt% adversely affects solderability. Thus the content of Zn should be 0.1 to 5.0 wt%.

Sn is an element that greatly improves the elastic limit. If the Si content is less than 0.1 wt%, only a little effect is produced. A Si content in excess of 2.0 wt% adversely affects hot working characteristics and decreases electrical conductivity below 25% IACS. Thus the content of Sn should be 0.1 to 2.0 wt%.

Mg is an essential element that forms a compound in the matrix with S which is present in the raw materials or enters from the furnace refractories. Thus Mg improves hot working characteristics. If the content of Mg is less than 0.001 wt%, S remains in elemental form of and migrates to the grain boundary to cause intergranular cracking during heating for hot working or during hot working. Mg in excess of 0.01 wt% forms a eutectic $Cu+MgCu_2$ (melting point 722° C.) in the ingot. An ingot containing this eutectic $Cu+MgCu_2$ cannot be heated to 800° to 900° C. at which hot working is performed. In addition, excess Mg causes the molten metal to be readily oxidized and considerably decreases the fluidity, with the result that the resulting ingot is poor in quality due to a large amount of oxides formed thereon. Thus the content of Mg should be 0.001 to 0.01 wt%. Incidentally, Mg may be replaced by 0.001 to 0.01 wt% of Ca to produce the same effect.

Cr, Ti, and Zr prevent the cracking in hot working which is inevitable even though the above-mentioned elements are added in the specified amounts. If their content is less than 0.001 wt%, it is impossible to prevent the cracking during hot working. If their content exceeds 0.01 wt%, the molten metal is liable to oxidation and the resulting ingot is poor in quality. Thus the content of Cr, Ti, or Zr should be 0.001 to 0.01 wt%. Where two or more members of Cr, Ti, and Zr are contained, their total content should be 0.001 to 0.01 wt%; otherwise, the above-mentioned effect is not produced.

The copper alloy of this invention may be incorporated with less than 0.2 wt% of one or more elements selected from Fe, Co, and Al. They produce no adverse effects in practical use on the hot working characteristics and other properties required from the product such as high electrical conductivity, strength, heat resistance, solderability, and resistance to peeling of solder by heat.

The next description is concerned with the process for producing the copper alloy for terminals and connectors.

After hot working of an ingot of the copper alloy of the abovementioned composition, cooling is started from a temperature above 600° C. at a rate of 5° C. per second or higher. If quenching starts from a temperature below 600° C. after hot rolling, precipitation and hardening take place before the start of quenching and the subsequent cold rolling is adversely affected, even though the cooling rate is higher than 5° C. per second. Likewise, if the cooling rate is lower than 5° C. per second, precipitation and hardening take place, even though the quenching starts from a temperature above 600° C. This also adversely affects the subsequent cold rolling. After cold working, annealing is performed at a temperature above 600° C. for 5 seconds to 4 hours in order for a recrystallization to take place and to develop a formability of the copper alloy of the above-mentioned composition. If annealing is performed below 600° C., recrystallization does not take place, even though the annealing time is 5 seconds to 4 hours. Annealing for shorter than 5 seconds does not provide sufficient recrystallization and annealing for longer than 4 hours is uneconomical.

After the next cold rolling, annealing is performed at a temperature of 400° to 600° C. for 5 minutes to 4 hours. This temperature range was selected because the precipitation of Ni-Si compound reaches a maximum or the electrical conductivity reaches a maximum when the annealing after cold rolling is performed at 500° to 550° C. If the annealing temperature is lower than 400° C., the precipitation of Ni-Si compound is incomplete. At an annealing temperature higher than 600° C., the Ni-Si compound is reduced to solid solution. Ni and Si in the solid solution adversely affect the resistance of peeling to solder and tin plating by heat. Thus the annealing temperature should be 400° C. to 600° C. Annealing shorter than 5 minutes does not provide sufficient precipitation and annealing longer than 4 hours is uneconomical.

After refining finish rolling, tension annealing is performed at a temperature of 300° to 600° C. for 5 to 60 seconds in order to remove local stress and provide a flat strip or sheet having a high elastic limit. The lowest annealing temperature should be 300° C. for the removal of local stress. Annealing at a temperature higher than 600° C. reduces the Ni-Si compound into solid solution, resulting in a product of with poor properties. Annealing shorter than 5 seconds does not provide a flat sheet, and annealing longer than 60 seconds is uneconomical.

EXAMPLES

The lead frame material for semiconductors and the process for producing the same are illustrated with the following examples.

Each of the copper alloys of the compositions as shown in Table 1 was molten in the atmosphere under a charcoal cover using a kryptol furnace. The molten copper alloy was poured into a book mold of cast iron measuring 45 mm thick, 80 mm wide, and 200 mm long. Both sides of the ingot were scraped off to a depth of 2.5 mm. The ingot was hot rolled to a thickness of 10 mm at 850° C., followed by water cooling from 600° C. or above at a rate of 30° C. per second. After descaling, the hot rolled metal was cold rolled to a thickness of 0.5 mm, followed by annealing at 500° C. for 120 minutes. The cold rolled sheet again underwent cold rolling to give a 0.25 mm thick sheet. This sheet was annealed at 500° C. for 20 seconds using a saltpeter bath furnace.

Table 2 shows the test results of the samples thus obtained.

The test methods used are as follows:

(1) Tensile strength was measured using test pieces, JIS No. 13B, cut parallel to the rolling direction. Hardness was measured with a micro-Vickers hardness meter.

(2) The Repeated bending test was performed using a press-punched lead, 0.5 mm wide, as a test piece. The test consists in bending the test piece through 90° both ways in one direction, with a 227 g weight suspending from one end of the test piece, until rupture occurs. The result is reported as the number of bends (made in both ways) before failure. An average value for five specimens is indicated. The axis of bending is parallel to the rolling direction.

(3) Stiffness strength was measured using a test piece measuring 0.25 mm thick, 10 mm wide, and 60 mm long, cut perpendicular to the rolling direction. Stiffness strength is expressed as a bending moment required for the specimen to reach a displacement angle of 10° when bent into a radius of curvature of 40 mm.

(4) Heat resistance was evaluated by measuring the hardness of the specimen which had been heated at 450° C. for 5 minutes using a saltpeter bath furnace.

(5) Resistance to peeling of solder by heat was evaluated by observing whether or not solder peeled off when a soldered specimen was bent at an angle of 90° after heating at 150° C. for 500 hours. Soldering was performed using a low active flux and a solder (Sn60-Pb40) bath at 230° C.

TABLE 1

| Sample No. | Ni | Si | Mn | Zn | Sn | Mg | Cr | Ti | Zr | Cu | Remarks |
|---|---|---|---|---|---|---|---|---|---|---|---|
| | Composition (wt %) | | | | | | | | | | |
| 1 | 1.61 | 0.34 | 0.027 | 0.29 | 0.46 | 0.004 | 0.004 | — | — | Balance | Example |
| 2 | 3.20 | 0.68 | 0.034 | 0.31 | 0.48 | 0.006 | — | — | 0.007 | Balance | Example |
| 3 | 3.23 | 0.69 | 0.033 | 0.30 | 1.01 | 0.006 | — | 0.006 | — | Balance | Example |
| 4 | 3.24 | 0.65 | 0.029 | 0.28 | 1.29 | 0.005 | 0.008 | — | — | Balance | Example |
| 5 | 1.63 | 0.35 | 0.031 | 0.33 | — | — | — | — | — | Balance | Compar. Example |
| 6 | 3.28 | 0.64 | 0.029 | 0.31 | — | — | — | — | — | Balance | Compar. Example |

TABLE 2

| Sample No. | Tensile strength (kgf/mm$^2$) | Hardness (MHV) | Elongation (%) | Repeated bending (times) | Stiffness strength (grf-cm) | Heat resistance (MHV) | Resistance to peeling of solder by heat | Hot rolling characteristics | Remarks |
|---|---|---|---|---|---|---|---|---|---|
| 1 | 57.5 | 173 | 8.6 | 12.4 | 177 | 146 | Good | Good | Example |
| 2 | 63.7 | 200 | 9.1 | 13.2 | 207 | 193 | Good | Good | Example |
| 3 | 65.0 | 204 | 9.0 | 14.1 | 208 | 194 | Good | Good | Example |
| 4 | 65.7 | 206 | 9.2 | 14.9 | 210 | 197 | Good | Good | Example |
| 5 | 50.1 | 152 | 7.2 | 9.1 | 171 | 129 | Peeling | Poor | Compar. Example |
| 6 | 59.8 | 187 | 8.5 | 9.8 | 200 | 186 | Peeling | Poor | Compar. Example |

The copper alloy for terminals and connectors and the process for producing the same are illustrated with th following examples.

Each of the copper alloys, No. 1 to No. 7, of the compositions as shown in Table 3 was molten in the atmosphere under a charcoal cover using a kryptol furnace. The molten copper alloy was poured into a book mold of cast iron measuring 50 mm thick, 80 mm wide, and 130 mm long. The surfaces of the ingot were scraped off to a depth of 2.5 mm, so that the thickness of the ingot was reduced to 45 mm. The ingot was hot rolled to a thickness of 15 mm at 880° C., followed by reheating at 700° C. for 30 minutes and cooling with shower water. The cooling rate was 30° C. per second.

After descaling with an aqueous solution of sulfuric acid and hydrogen peroxide, the hot rolled metal was cold rolled to a thickness of 0.54 mm, followed by annealing at 750° C. for 20 seconds using a saltpeter bath furnace. After descaling with the above-mentioned pickling solution, the cold rolled sheet was cold rolled again to a thickness of 0.46 mm, followed by annealing at 500° C. for 120 minutes in a furnace with a nitrogen atmosphere. After descaling with the above-mentioned pickling solution, the cold rolled sheet underwent again cold rolling to give a 0.32 mm thick sheet, the reduction of area being about 30%.

In the cases of comparative alloys No. 6 and No. 7 in Table 1, cracking occurred during the hot rolling. In other words, No. 6 suffered silver and No. 7 suffered severe overall cracking. Therefore, these alloys were cast into ingots again. Each ingot was cold rolled to a thickness of 15 mm, followed by heating at 700° C. for 30 minutes. The rolled metal was cooled in the same manner as in No. 1 to No. 5.

Comparative alloy No. 8 is a kind of commercial phosphor bronze. The thickness before finishing was 0.64 mm and the reduction of area for refining finish was 50%.

The sheets No. 1 to No. 7 were annealed at 450° C. for 30 seconds using a saltpeter bath furnace. They underwent pickling with an aqueous solution containing sulfuric acid and hydrogen peroxide.

TABLE 3

| Alloy No. | Ni | Si | Mn | Zn | Sn | Mg | Cr | Ti | Zr | Cu |
|---|---|---|---|---|---|---|---|---|---|---|
| | Composition (wt %) | | | | | | | | | |
| 1 | 1.61 | 0.34 | 0.03 | 0.29 | 0.46 | 0.004 | 0.005 | — | — | Balance |
| 2 | 3.20 | 0.71 | 0.03 | 0.31 | 0.51 | 0.006 | — | — | 0.007 | Balance |
| 3 | 3.23 | 0.69 | 0.03 | 0.30 | 1.06 | 0.006 | — | 0.006 | — | Balance |
| 4 | 3.24 | 0.65 | 0.03 | 0.28 | 1.29 | 0.005 | 0.008 | — | — | Balance |
| 5 | 3.25 | 0.71 | 0.04 | 0.33 | 1.95 | 0.002 | 0.003 | — | 0.002 | Balance |
| 6* | 1.63 | 0.35 | 0.03 | 0.03 | 0.05 | — | — | — | — | Balance |
| 7* | 3.28 | 0.73 | 0.03 | — | 0.25 | — | — | — | — | Balance |

TABLE 3-continued

| Alloy No. | Ni | Si | Mn | Zn | Sn | Mg | Cr | Ti | Zr | Cu |
|---|---|---|---|---|---|---|---|---|---|---|
| | Composition (wt %) | | | | | | | | | |
| 8* | Cu - 4.2 wt % Sn - 0.06 wt % P | | | | | | | | | |

*Comparative alloys

Table 4 shows the test results of the samples thus obtained. The test methods used are as follows:

(1) Tensile strength was measured using test pieces, JIS No. 13B, cut parallel to the rolling direction. Hardness was measured with a micro-Vickers hardness meter.

(2) The elastic limit test was performed using a 10 mm wide specmen cut parallel to the rolling direction. The specimen underwent the moment type test according to JIS H3130.

(3) Electrical conductivity was measured according to JIS H0505 which provides the methods for measuring the volume resistivity and electrical conductivity of non-ferrous materials.

(4) Heat resistance was calculated from the hardness of the specimen which had been annealed in a saltpeter bath furnace and a salt bath furnace.

(5) Resistance to peeling of solder by heat was evaluated by observing whether or not solder peeled off when a soldered specimen was bent at an angle of 90° after heating at 150° C. for 500 hours. Soldering was performed using a low active flux and a solder (Sn60-Pb40) bath at 230° C.

(6) Bendability was evaluated by observing whether or not a specimen can withstand a 90° bend in the transverse grain direction with 0° bending radius without fracture as determined on the microscope at 30X magnification.

TABLE 4

| Alloy No. | Tensile strength ($kgf/mm^2$) | Hardness (MHV) | Elongation (%) | Elastic limit ($Kb_{0.1}$, $kgf/mm^2$) | Electrical conductivity (% IACS) |
|---|---|---|---|---|---|
| 1 | 51.5 | 165 | 10.6 | 40.8 | 47 |
| 2 | 63.7 | 181 | 9.1 | 47.8 | 45 |
| 3 | 64.5 | 192 | 10.0 | 50.2 | 37 |
| 4 | 63.5 | 194 | 11.4 | 54.1 | 34 |
| 5 | 64.5 | 198 | 12.0 | 57.9 | 28 |
| 6* | 48.0 | 152 | 9.8 | 28.7 | 55 |
| 7* | 68.9 | 207 | 10.4 | 58.2 | 23 |
| 8* | 63.4 | 210 | 10.2 | 39.6 | 23 |

| Heat resistance** (°C.) | Resistance to peeling of solder by heat | Hot rolling characteristics | Bendability of a 90° bend with 0° bending radius |
|---|---|---|---|
| 490 | Good | Good | Good |
| 560 | Good | Good | Good |
| 560 | Good | Good | Good |
| 565 | Good | Good | Good |
| 550 | Good | Good | Good |
| 475 | Peeled in 24 hr | Many slivers | — |
| 545 | Peeled in 24 hr | Severe overall cracking | — |
| 350 | Good | No good | — |

**Temperature of heat treatment that provides 80% of the initial hardness (Hv) after heating for 5 minutes.

It is noted from Table 2 that samples No. 1 to No. 4 of this invention have superior properties on the whole that make them suitable for the lead frame material for semiconductors. In addition, they are improved over samples No. 5 and No. 6 (in comparative examples) as mentioned below.

Sample No. 1, which contains Sn, has improved strength, stiffness strength, and repeated bending characteristics over sample No. 5 (in comparative example). It also has improved in hot rolling characteristics because it contains Mn, Mg, and Cr, and it has improved resistance to peeling of solder by heat because it contains Zn.

Samples No. 2, No. 3, and No. 4, which contain Sn, have improved strength, stiffness strength, and repeated bending characteristics over sample No. 6 (in comparative example). They also have improved in hot rolling characteristics because they contain one of Cr, Ti, and Zr in addition to Mn and Mg, and they have improved resistance to peeling of solder by heat because they contain Zn.

It is noted from Table 5 that the copper alloy for terminals and connectors of this invention is superior to commercial phosphor bronze (No. 8) in elastic limit required by the materials for terminals and connectors. This is attributable to tin in the alloy. Tin increases tensile strength, hardness, elongation, and elastic limit, but at the same time, it decreases electrical conductivity. In the case of comparative alloy No. 7 which contains more than 2 wt% of tin, it has an electrical conductivity of 23% IACS.

In addition, the copper alloys (No. 1 to No. 5) for terminals and connectors of this invention are superior in adhesion of solder, which is an essential prerequisite to electronic parts, because they contain 0.1 to 5.0 wt% of Zn, whereas in the cases of alloys No. 6 and No. 7, peeling occurred within 24 hours. Moreover, comparative alloys No. 6 and No. 7 are poor in hot rolling characteristics because they do not contain any of Cr, Ti, and Zr.

Samples No. 1 to 5 of this invention have superior properties in bendability required by the materials for terminals and connectors. This is attributable to the internal annealing of samples at 750° C. for 20 seconds using a saltpeter bath furnace. By this internal annealing, recrystallization of samples take place and bendability is developed.

What is claimed is:

1. A copper alloy which consists essentially of 1.0 to 3.5 wt% of Ni, 0.2 to 0.9 wt% of Si, 0.02 to 1.0 wt% of Mn, 0.1 to 5.0 wt% of Zn, 0.1 to 2.0 wt% of Sn, 0.001 to 0.01 wt% of Mg, and 0.001 to 0.01 wt% of at least one member selected from the group consisting of Cr, Ti, and Zr, with the remainder being substantially Cu.

2. A lead frame for semiconductors comprised of the alloy of claim 1.

3. A copper alloy which consists essentially of 1.0 to 3.5 wt% of Ni, 0.2 to 0.9 wt% of Si, 0.01 to 1.0 wt% of Mn, 0.1 to 5.0 wt% of Zn, 0.1 to 2.0 wt% of Sn, 0.001 to 0.01 wt% of Mg, and 0.001 to 0.01 wt% of at least one member selected from the group consisting of Cr, Ti, and Zr, with the remainder being substantially Cu.

4. Terminals and connectors therefor comprised of the alloy of claim 3.

* * * * *